United States Patent [19]

Kobayashi et al.

[11] 4,075,274

[45] Feb. 21, 1978

[54] METHOD FOR DRAWING AND HEAT-TREATING POLYESTER YARNS

[75] Inventors: Isao Kobayashi; Yoshiharu Asada, both of Matsuyama; Shiro Kumakawa, Iwakuni, all of Japan

[73] Assignee: Teijin Limited, Osaka, Japan

[21] Appl. No.: 668,037

[22] Filed: Mar. 18, 1976

Related U.S. Application Data

[63] Continuation of Ser. No. 457,143, April 1, 1974, abandoned.

[30] Foreign Application Priority Data

Apr. 7, 1973 Japan ..... 48-39123

[51] Int. Cl.[2] ..... B29C 17/02

[52] U.S. Cl. ..... 264/290 T; 264/40.7; 264/DIG. 73

[58] Field of Search ..... 264/290 N, 290 R, 290 T, 264/210 F, DIG. 73, 342 RE, 40.1, 40.7; 28/71.3

[56] References Cited

U.S. PATENT DOCUMENTS

| | | | |
|---|---|---|---|
| 2,956,330 | 10/1960 | Pitzl | 264/290 N |
| 2,988,866 | 6/1961 | Klukamm et al. | 264/342 RE |
| 3,090,077 | 5/1963 | Abbott | 264/290 R |
| 3,099,872 | 8/1963 | Siggel et al. | 28/71.3 |
| 3,436,450 | 4/1969 | Specker et al. | 264/290 R |
| 3,890,422 | 6/1975 | Livingston | 264/DIG. 73 |

FOREIGN PATENT DOCUMENTS

| | | | |
|---|---|---|---|
| 15579-68 | 7/1968 | Japan | 264/290 R |

*Primary Examiner*—James B. Lowe
*Attorney, Agent, or Firm*—Sherman & Shalloway

[57] ABSTRACT

A method for drawing and heat-treating an undrawn polyester yarn by drawing the polyester yarn between a heated feed roller and at least one heated draw roller, wherein the surface temperature of the last draw roller is progressively raised from its yarn in-coming side to its yarn out-going side, the yarn is shrunken both on the last draw roller and between the last draw roller and the take-up roller, and the yarn is cooled on the take-up roller. Further, after the method has resumed after being stopped, the running speed of the yarn on the take-up roller is maintained at not more than $(100-5.7\times S)$m/min., wherein S is the total shrinkage of the yarn until the yarn heated during the stoppage has been allowed to shrink in the subsequent step. The yarn is then passed over the take-up roller at a running speed of 200 to 1200 m/min. An apparatus for performing the above method, characterized by the provision of a shrinking part in the last draw roller, means for heating the surface temperature of the last draw roller progressively from its yarn in-coming side to its yarn out-going side and a groove on a separator roller associated to the penultimate draw roller for regulating the yarn path of the last turn of the yarn.

10 Claims, 3 Drawing Figures

METHOD FOR DRAWING AND HEAT-TREATING POLYESTER YARNS

Figure 1:
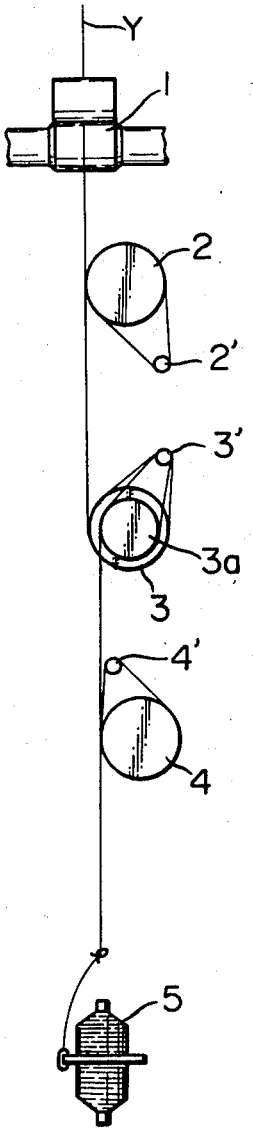

This is a continuation of application Ser. No. 457,143, filed Apr. 1, 1974, now abandoned.

This invention relates to a method for drawing and heat-treating polyester yarns, and to an apparatus for performing this method.

Usually, polyester yarns are heat-treated after drawing in order to improve their dimensional stability to heat. The heat-treatment is usually carried out by providing a hot plate or slit heater between a feed roller or draw pin and a draw roller in a drawing apparatus and allowing a drawn yarn to run in contact with or through it; or by using a heated draw roller and wrapping the drawn yarn around it. However, such a heat-treatment does not satisfactorily result in the lowering of the thermal shrinkage of the resulting product, nor does it bring about an appreciable improvement in tenacity and elongation of the product.

With a view to overcoming such disadvantages, there has been conceived a method wherein the heated draw roller is constructed as a stepped roller or tapered roller, and shrinkage is given to the drawn yarn on this roller, and a method wherein a take-up roller rotating at a slower peripheral speed than the heated draw roller is provided next to the draw roller, and shrinkage is given to the drawn yarns between these two rollers. With these methods, however, it is difficult to obtain a product having sufficiently low thermal shrinkage.

We have now found that by a combination of hot drawing of a yarn on a heated feed roller and a special two-staged shrinkage treatment, yarns having very low thermal shrinkage and superior tenacity and break elongation can be obtained.

The present invention provides a method for drawing and heat-treating a polyester yarn, which comprises feeding an undrawn multifilament yarn of a linear polyester having a second order transition point Tg over a heated feed roller having a surface temperature of (Tg − 10° C.) to (Tg + 30° C.); withdrawing the yarn by at least one heated draw roller thereby to draw the undrawn yarn at a predetermined total draw ratio, each of the draw rollers except the last draw roller having a surface temperature higher than that of the preceding heated draw roller, the surface temperature of the last draw roller rising continuously or stepwise from the yarn in-coming side to the yarn out-going side, and the maximum surface temperature of the last draw roller being higher than the surface of the preceding heated draw roller; allowing the drawn yarn to shrink by 1 to 10% on the last draw roller; further allowing the yarn to shrink by 1 to 10% between the last draw roller and a non-heated take-up roller; cooling the yarn on the take-up roller; and then winding the resultant yarn.

According to this invention, there is also provided an apparatus for drawing and heat-treating an undrawn yarn of a linear polyester, comprising a combination of a heated feed roller for feeding the yarn and a separate roller associated with it; combinations of at least one heated draw roller and its associated separator roller, the last heated draw roller having on the yarn out-going side a shrinking portion for shrinking the yarn on it, the shrinking portion being formed of a roller portion of a smaller diameter or a tapered portion, the last heated draw roller having a heating device for progressively raising its surface temperature from the yarn incoming side to the yarn outgoing side, and a separator roller associated with the heated roller immediately preceding the last heated draw roller having a groove for regulating the yarn path of at least the final turn on its separate roller; a non-heated take-up roller rotating at a smaller peripheral speed than that of the shrinking portion of the last heated draw roller; and a winder for winding up the yarn.

Figure 2:
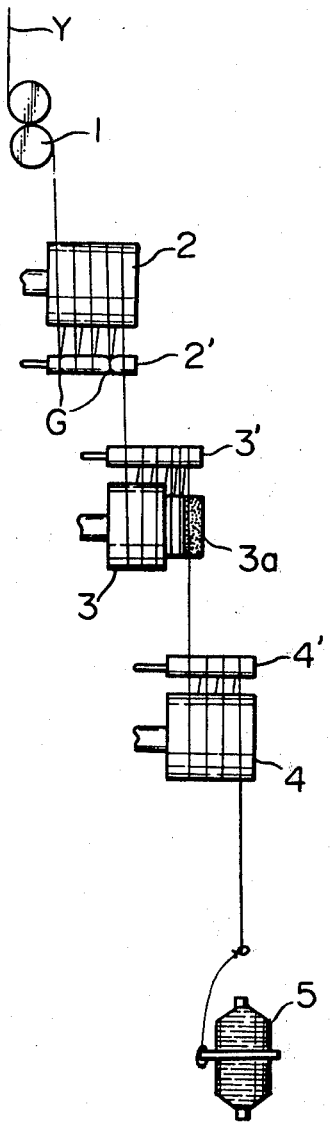
Figure 3:
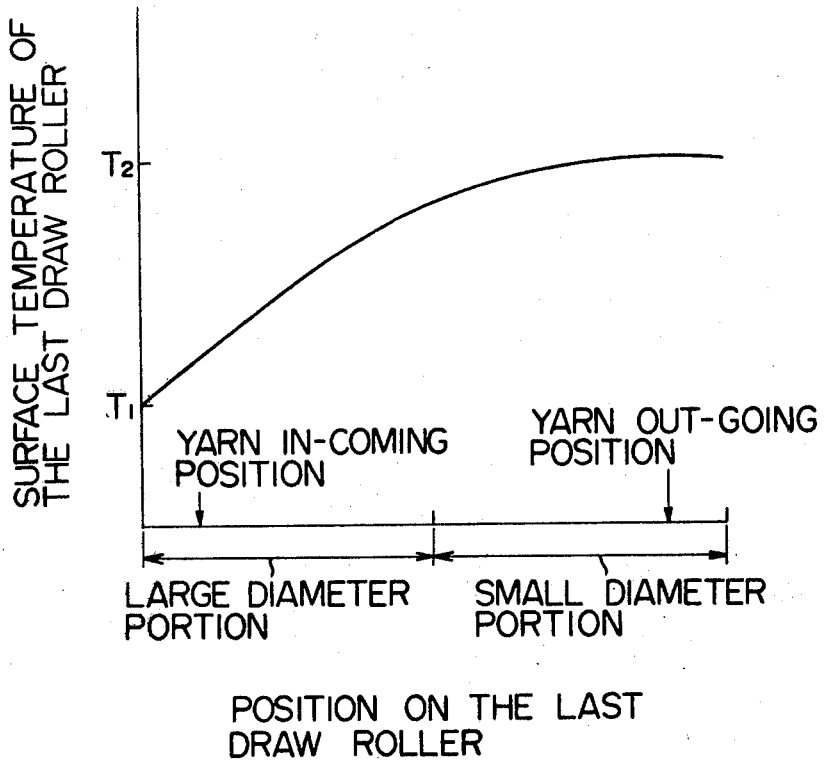

The present invention will be described in greater detail by reference to the accompanying drawings in which:

FIGS. 1 and 2 are a schematic front elevation and a schematic side elevation, respectively, of one embodiment of the drawing and heat-treating aparatus of this invention; and FIG. 3 is a graphic representation showing one example of the gradient of the surface temperature of the last heated draw roller.

The polyester yarn to which the present invention is applicable is primarily a multifilament yarn of polyethylene terephthalate. But it may also be a multifilament yarn of a copolyester in which the ethylene terephthalate units account for at least 80 mol %, preferably at least 95 mol %, of its recurring units. Preferably, these polyesters have an intrinsic viscosity, as measured on an o-chlorophenol solution at 30° C., of 0.55 to 0.75. The undrawn polyester yarn preferably has a birefringence of not more than $6 \times 10^{-3}$.

The second order transition point, as used in the present specification and the appended claims, is a value measured by the method disclosed in U.S. Pat. No. 2,556,925.

The cross-sectional shape of a single filament of the polyester yarn used in this invention may be not only circular but also a non-circular shape such as a triangle, tetragon, or cross. It also may be a hollow filament. The total denier of the yarn may be any desired value, but generally, it is preferred that the total denier after drawing should be 20 to 2000. Also, the yarn may contain an additive such as a delusterant, a pigment or a modifier.

FIGS. 1 and 2 show one example of the apparatus for performing the method of this invention in which only one heated draw roller is provided. Referring to FIGS. 1 and 2, Y represents an undrawn yarn; 1, a nip roller; 2, a heated feed roller; 2', a separator roller therefor; 3, a heated draw roller; 3', a separator roller therefor; 4, a non-heated take-up roller; 4', a separator roller therefor; and 5, a winder. Since in these drawings, there is only one heated draw roller, the heated draw roller 3 is a final heated draw roller.

The undrawn yarn Y taken out from a package (not shown), if desired, is first given a pre-tension by being stretched to 1.00 to 1.01 times, preferably 1.001 to 1.008 times, its original length between the nip roller 1 and the heated feed roller 2, and then wound around the heated feed roller 2 and the separator roller 2' through several turns or more. The surface temperature of the heated feed roller 2 is maintained substantially at a certain predetermined temperature within the range of (Tg − 10° C.) to (Tg + 30° C.) according to the second order transition point (Tg) of the polyester, and the yarn is heated to this temperature. Then, the heated yarn is drawn between the heated feed roller 2 and the heated draw roller 3 at a predetermined draw ratio. In the method of this invention, the draw ratio is preferably adjusted to 3.5 to 7.5. Where two heated draw rollers are used and the yarn is drawn in two steps, it is preferred that the draw ratio in the first step should be adjusted to 2.5 to 5.0, and the draw ratio in the second step should be adjusted so that the total draw ratio becomes 3.5 to 7.5.

The last heated draw roller includes a shrinking portion on its yarn out-going side so that after being drawn at a predetermined draw ratio, the yarn is allowed to shrink by 1 to 10%, preferably 5 to 9%, on the shrinking portion. In FIGS. 1 and 2, the shrinking portion is formed of a roller portion 3*a* of smaller diameter which is provided on the yarn out-going side of the last heated draw roller 3. When the last heated draw roller is a stepped roller composed of a large-diameter portion and a smaller-diameter portion 3*a*, the yarn shrinks on the smaller-diameter portion 3*a* by the difference in peripheral speed between the portion 3*a* and the large-diameter portion. Instead of providing such a stepped roller as the last draw roller, it is also possible to construct the final draw roller in such a way that its yarn out-going side is of a tapered configuration, and to use the tapered portion as the shrinking portion.

It is essential in the method of this invention that the shrinkage of the yarn on the shrinking portion of the final draw roller should be adjusted to 1 to 10%. If the shrinkage of the yarn is lower than the lowest limit of the above-specified range, the effect of improving the dimensional stability, tenacity and elongation of the yarn is poor. On the other hand, it is extremely difficult to impart a higher shrinkage than the upper limit specified above.

It is further essential in the method of this invention that the surface temperature of the last heated draw roller should be elevated continuously or stepwise from the yarn in-coming side to the yarn out-going side. One example of the temperature gradient of the surface of the last heated draw roller 3 is shown in FIG. 3. In the case of a multifilament yarn of polyethylene terephthalate, the temperature ($T_1$) of the last heated draw roller at the yarn in-coming part is suitably 80° to 200° C., and the temperature $T_2$ of the roller at the yarn out-going part is suitably 5° to 100° C. higher than $T_1$. The especially suitable temperature $T_2$ is higher than $T_1$ by 15° to 50° C., and within the range of 100° to 220° C., preferably 100° to 210° C.

The residence time of the yarn on the last heated draw roller is 0.005 to 2 seconds, preferably 0.3 to 1 second.

Subsequent to the first-step shrinking heat-treatment on the last heated draw roller 3, the yarn is further allowed to shrink by 1 to 10%, preferably 1 to 5%, between the last heated draw roller 3 and the take-up roller 4 rotating at a slower peripheral speed than that of the shrinking portion.

Since a temperature gradient is provided on the last heated draw roller 3, troubles such as deterioration or melt-adhesion do not occur even when the temperature of the roller on the yarn out-going side is made considerably higher. Accordingly, the yarn which has been allowed to shrink by 1–10% on the heated draw roller by elevating the temperature of the last heated draw roller can be again shrunk by 1–10%.

When a high degree of shrinkage is given in such a two-step shrinking treatment, the tension of the yarn becomes lower, and therefore, it is preferred to finish the yarn out-going side of the last heated draw roller in a matte surface.

The take-up roller 4 may be a non-heated roller held at the ambient temperature, or a positively cooled roller. By the take-up roller 4, the yarn which has been subjected to the two-step shrinking treatment is cooled to a temperature near room temperature. The suitable take-up speed is 200 to 1,200 m/min.

The above description by reference to the accompanying FIGS. 1 and 2 has been made with regard to one embodiment of this invention in which there is only one heated draw roller. However, in the present invention, the drawing of the yarn can be performed in multi-stage by providing two or more heated draw rollers. In this case, the surface temperture of each heated draw roller is preferably higher than that of the preceding roller. In other words, the surface temperature of the first heated draw roller is higher than that of the heated feed roller, and the last heated draw roller having a temperature gradient has a maximum surface temperature higher than that of a heated draw roller immediately preceding it. Where two or more heated draw rollers are used, all draw rollers except the last one are ordinary rollers having a uniform diameter. When the drawing of the yarn is performed in multi-stage using two or more heated draw rollers, the number of the heated draw rollers is preferably 2.

As the last draw roller has a gradient in its surface temperature, the temperature of the last draw roller differs from place to place on its surface. Thus, when the position of introducing the yarn from the preceding roller to the last draw roller varies, the thermal history of the yarn on the last draw roller changes to cause non-uniformity in the quality of the final product. It is necessary therefore to fix the point of introducing the yarn into the last draw roller. In order to accomplish this, it is preferable to provide a groove at least on the yarn out-going side of a separator roller associated with a heated draw-roller immediately preceding the last draw roller so as to fix the yarn path of the yarn to be introduced into the last draw roller. When only one heated draw roller is used as shown in FIGS. 1 and 2, the yarn path of the yarn to be introduced into the draw roller 3 is fixed by providing a groove G at least on the yarn out-going side of the separator roller 2' associated with the heated feed roller 2 in order to ensure the fixation of the yarn path. When two or more heated draw rollers are used, a similar groove is provided at least on the yarn out-going side of a separator roller associated with a heated draw roller immediately preceding the last heated draw roller. It is preferred that the groove G of the separator roller should be provided on the yarn in-coming side or at the central part of the separator roller in addition to the yarn out-going side. Especially when a yarn of heavy denier is drawn, it is preferred to regulate the yarn path by providing a groove at every turn. Furthermore, it is more preferred to provide such a groove not only on the separator roller associated with a heated roller immediately preceding the last heated draw roller, but also on separator rollers associated with all heated rollers.

In the practice of the method of this invention, it is often required for various reasons to stop the operation for a while, and then resume the operation. If in such a case, the shrinking heat-treatment is started in such a way that the speed of the running yarn immediately becomes the desired value (for example, the running speed on the take-up roller is preferably 200 to 1,200 m/min.), the yarn is frequently broken at the time of starting. This causes a fatal defect to the production of yarns of uniform quality, and a drastic decrease in yield. The cause of the yarn breakage is presumed to be that the yarn staying in the heating parts (that is, the heated feed roller and the heated draw roller) of the shrinking heat-treatment during the stopping of operation undergoes heat-treatment for a longer time than the yarn in normal operation, and therefore is crystallized to a greater extent. Thus, the yarn is very difficult to draw, and when the running speed of the yarn is immediately set at the desired value upon resumption of the operation, the yarn is excessively stretched, which in turn will result in the breakage of the yarn.

We have now found that when the operation of the method is resumed after stoppage, such yarn breakage can be prevented effectively by maintaining the running speed of the yarn on the take-up roller at not more than $(100 - 5.7 \times S)$ wherein S is the total shrinkage of the yarn at least until the yarn heated during the stoppage of the operation has been allowed to shrink in the subsequent step, and then passing the yarn on the take-up roller at the predetermined speed.

The yarn which has been hot drawn and subjected to the two-step shrinking treatment in accordance with the method of this invention has very low shrinkage in boiling water and in dry heat at 150° C. Usually, the shrinkage of the resulting yarn in boiling water is not more than 5%, in some cases, not more than 1%, and its shrinkage in dry heat at 150° C. is usually 1.5%. Furthermore, the tenacity and elongation of the resulting yarn increase, and as a result, its toughness also increases. Usually the yarn has a tenacity of at least 6.0 g/d, and a break elongation of at least 15%.

Especially when the drawing of the yarn is carried out using two heated draw rollers, there is the advantage that the tenacity of the resulting yarn increases.

The polyester yarns produced in accordance with the method of this invention are suitable for use in fields which require strict dimensional stability, for example, for use as fishing nets, reinforcing materials for rubber articles, and sails of yachts. Furthermore, they may be used in combination with high shrinkage yarns to produce bulky woven fabrics.

The following Examples illustrate the method of this invention in greater detail.

EXAMPLE 1

An undrawn yarn of polyethylene terephthalate having an intrinsic viscosity $[\eta]$ of 0.72 and a birefringence $(\Delta n)$ of $4.5 \times 10^{-3}$ was drawn and subjected to a two-step shrinking treatment using a drawing heat-treatment apparatus of the type shown in FIGS. 1 and 2 which included only one heated draw roller.

The conditions used were as follows:

| | |
|---|---|
| Prestretch | 1.0045 X |
| Surface temperature of the feed roller | 78° C. |
| Number of turns of the yarn wound around the feed rollers | 6 times |
| Draw ratio | 5.0 X |
| Surface temperature of the yarn in-coming part of the draw roller | 180° C. |
| Surface temperature of the yarn out-going part of the draw roller | 220° C. |
| Number of turns of the yarn wound around the draw roller | 6 times |
| Shrinkage of the yarn on the draw roller | 7% |
| Shrinkage of the yarn between the draw roller and the take-up roller | 5% |
| Surface temerature of the take-up roller | room temperature (25° C.) |
| Surface speed of the take-up roller | 600 m/min. |

The drawing and shrinkage treatment under the above conditions are designated Experiment No. 1—1. This experiment is one conducted in accordance with the method of this invention.

For comparison, Experiment No. 1—1 was repeated except that the draw roller was replaced by an ordinary heated draw roller of uniform diameter (that is, one not containing a smaller diameter portion). This experiment is designated Experiment No. 1-2. Since in this experiment, shrinkage of the yarn on the draw roller did not occur, the method of this experiment is outside the scope of this invention.

Furthermore, Experiment No. 1—1 was repeated except that the surface speed of the draw roller was made equal to that of the take-up roller. This experiment is designated Experiment No. 1-3. Since no shrinkage between rollers occurred in this experiment, the method of this experiment is outside the scope of this invention.

The properties of the polyester yarns as final products obtained in the above experiments are shown in Table 1.

Table 1

| Experiments Nos. | 1-1 | 1-2 | 1-3 |
|---|---|---|---|
| Shrinkage on the draw roller (%) | 7 | 0 | 7 |
| Shrinkage between rollers (%) | 5 | 5 | 0 |
| Product yarns | | | |
| Denier size (denier) | 250/48f | — | — |
| Tenacity (g/de) | 6.2 | 6.3 | 6.5 |
| Break elongation (%) | 29 | 18 | 20 |
| Shrinkage in boiling water (%) | 0.8 | 6 | 4 |
| Shrinkage in dry heat at 150° C (%) | 1.5 | 12.5 | 9.2 |

For comparison, Experiment No. 1—1 was repeated except that the surface temperature of the heated draw roller did not have a gradient, but was maintained at a uniform temperature as shown in Table 2 below. As shown in Table 2, the condition of drawing was very inferior to Experiment No. 1—1.

Table 2

| Temperature of the draw roller | Situation of drawing |
|---|---|
| 220° C. | The yarn was deterioated, and the drawing operability was extremely poor |
| 180° C. (many turns) | The tension of the yarn between rollers was low, and wrapping of the yarn about the rollers frequently occurred. |
| 180° C. (small number of turns) | There was hardly any effect of improving the boiling water shrinkage and the tenacity and elongation of the yarn. |

When in Experiment No. 1—1, the separator roller associated with the heated feed roller was changed to an ordinary roller (without a groove), the yarn swayed vigorously on the feed roller and the draw roller, and non-uniformity in physical properties and in dyeing occurred at many points of the yarn.

EXAMPLE 2

Experiment No. 1—1 was repeated except that the undrawn yarn used had an intrinsic viscosity of $[\eta]$ of 0.6; an ordinary heated draw roller of a uniform diameter having a surface temperature of 85° C. was disposed between the heated feed roller and the heated draw roller and the drawing was performed in two steps; the surface temperature of the feed roller was adjusted to 83° C.; the shrinkage between the last draw roller and the take-up roller was adjusted to 4%; the take-up roller was positive cooled with water to adjust its surface temperature to 20° C.; and the surface speed of the take-up roller was changed to 765 m/min. The total draw ratio in this example was 5.2X. The number of turns of the yarn about the first stage draw roller was 5. The draw ratio on the firststage draw roll was 3.25X, and the draw ratio on the final draw roller (stepped roller) was 1.6X. The polyester yarn obtained by the above procedure has the following properties.

| | |
|---|---|
| Denier size (de) | 250/48 filaments |
| Tenacity (g/den) | 7.2 |
| Break elongation (%) | 18 |
| Shrinkage in boiling water (%) | 0.5 |
| Shrinkage in dry heat at 150° C | 0.9 |

What we claim is:

1. A method for drawing and heat treating a polyester yarn which comprises the successive steps of:

A. feeding an undrawn multifilament linear polyester yarn having a second order transition point Tg over a heated feed roller having a substantially uniform surface temperature of from (Tg − 10° C) to (Tg + 30° C);

B. picking up the yarn from the preceding heated roller onto a heated draw roller having a surface temperature which increases continuously from the yarn in-coming roller surface contact point to the yarn out-going roller surface contact point and having a maximum surface temperature higher than the surface temperature of the preceding heated roller, at a total draw ratio from the heated feed roller of from 3.5 to 7.5;

C. picking up the yarn from the heated draw roller in step (B) onto a non-heated take-up roller;

D. cooling the yarn on the take-up roller; and

E. winding the yarn;

with the provisos that: (i) the yarn is shrunk from 1 to 10% on the heated draw roller in step (B), (ii) the yarn is shrunk a further 1 to 10% between the heated draw roller in step (B) and the take-up roller in step (C), and (iii) the yarn is picked up on the heated draw roller in step (B) at a low surface temperature point and discharged at a higher surface temperature point wherein when the operation of the method is resumed after stopping, the running speed of the yarn on the take-up roller is maintained at not more than (100 − 5.7 × S) m/min., wherein S is the total shrinkage of the yarn, until the yarn heated during stoppage has been shrunk in the subsequent shrinking step, and then the yarn is passed over the take-up roller at a running speed of 200 to 1200 m/min.

2. The method of claim 1 wherein said take-up roller is positively cooled.

3. The method of claim 1 wherein the shrinkage of the yarn on the heated roller in step (B) is 5 to 9%, and the shrinkage of the yarn between the heated draw roller in step (B) and the take-up roller is 1 to 5%.

4. The method of claim 1 wherein said undrawn yarn is pre-stretched at a ratio of 1.00X to 1.01X before introducing it to the heated feed roller.

5. The method of claim 1 wherein the residence time of the yarn on the heated draw roller in step (B) is 0.005 to 2 seconds.

6. The method of claim 1 in which the temperature of the heated draw roller in step (B) at the yarn in-coming roller surface contact point is from 80° to 200° C., and at the yarn out-going roller surface contact point is from 100° to 220° C., with the proviso that the temperature at the yarn out-going point is from 5° to 100° C. higher than at the yarn in-coming point.

7. The method of claim 6 in which the temperature at the yarn out-going point is from 100° to 210° C. and is from 15° to 50° C. higher than at the yarn in-coming point.

8. The method of claim 1 in which the polyester yarn is polyethylene terephthalate or a copolyester containing at least 80 mol percent of recurring ethylene terephthalate units.

9. The method of claim 5 in which the residence time is 0.3 to 1 second.

10. The method of claim 1 which further comprises, between step (A) and (B) picking up the yarn from the heated feed roller onto a uniformly heated draw roller having a substantially uniform surface temperature which is higher than that of the heated feed roller, at a draw ratio of from 2.5 to 5.0.

* * * * *